United States Patent [19]

Gibson

[11] Patent Number: 4,901,334

[45] Date of Patent: Feb. 13, 1990

[54] TRAFFIC COUNTER APPARATUS FOR SELECTIVE LANE USE

[76] Inventor: Guy P. Gibson, 48731 Roberts Rd., Oakridge, Oreg. 97463

[21] Appl. No.: 213,995

[22] Filed: Jun. 30, 1988

[51] Int. Cl.[4] ..... G08G 1/065; E01F 11/00

[52] U.S. Cl. ..... 377/9; 340/940

[58] Field of Search ..... 377/9; 340/940

[56] References Cited

U.S. PATENT DOCUMENTS

| | | | |
|---|---|---|---|
| 2,334,143 | 11/1943 | Basquin et al. | 377/9 |
| 3,427,933 | 2/1969 | Taylor-Myers | 404/9 |
| 3,587,416 | 6/1971 | Flanagan | 404/9 |
| 3,911,390 | 10/1975 | Myers | 340/940 |
| 3,949,355 | 4/1976 | Newmeyer | 340/940 |
| 3,950,725 | 4/1976 | Kitajima | 340/940 |
| 4,050,834 | 9/1977 | Lee | 404/16 |

OTHER PUBLICATIONS

Magazine page from highway trade publication entitled "International Transportation Engineer's Journal'-'—May or Jun. 1988 issue.

*Primary Examiner*—John S. Heyman

*Attorney, Agent, or Firm*—James D. Givnan, Jr.

[57] ABSTRACT

A housing assembly of the apparatus includes a roadway mounted base plate to which a housing is secured with the housing having a low profile and inclined side and end walls to permit placement of the housing assembly along a course of lane markers. The housing defines a chamber in which transducer and electronic components are housed. A collapsible road tube terminates within the housing in communication with the transducer. A retainer prevents road tube separation from the housing. An electrical cable of flat section passes downwardly through the base plate and terminates at a remote tallying component.

4 Claims, 1 Drawing Sheet

T
C
M
1
3
2
L1
M
14
S
D
L2
C
S
1
2B
2D
4
2
2C
22
4
2A
21
2E
3
20
14

8
13
2C
14
12
11
2E
8
P
R
8
P
15
16
17
8
2
2D 3A
9
10A
10
9
3

TRAFFIC COUNTER APPARATUS FOR SELECTIVE LANE USE

BACKGROUND OF THE INVENTION

The present invention pertains generally to counters or tallying devices which are actuated by vehicle passage over a sensing means in place on a roadway surface.

Widely used by various governmental departments are devices for tallying the number of vehicles moving along a traffic lane past a counting site. Toward this end collapsible road tubes are used in some installations along with pressure responsive transducer to provide a signal to a counter located at the side of the roadway.

Road tubes may be a length to extend across several lanes of traffic to provide the counter mechanism signals corresponding to cumulative traffic flow in all the lanes. A difficulty arises when it is desired to selectively count all traffic flow in a middle or inside lane of a multi-lane freeway or expressway. In such instances certain segments of the road tube would have to be shielded from being collapsed by the wheels of vehicles moving in the outside lane. Such shielding is, in the least, objectionable particularly since on such roadways vehicles move at high speed. Accordingly, a problem exists in the selective counting of vehicle passage in a middle or inner lane of a multi-lane roadway.

SUMMARY OF THE PRESENT INVENTION

The present invention is embodied in a traffic counting apparatus particularly suited for sensing vehicle traffic in any selected lane of a multiple lane roadway.

A housing assembly is adapted to be placed in an unobtrusive manner between two traffic lanes to sense pressure fluctuations being converted by means within the housing assembly into electrical impulses for transmission to a tallying device located at the side of the roadway. The housing assembly is of a size and shape so as to be inconspicuous and not interfere with vehicle travel thereover or be susceptible to damage from wheel contact. Toward these end, the housing per se defines a chamber to receive pressure responsive switch means such as a transducer with electronic components conditioning transducer output for transmission to a remote location such as a tallying device along the shoulder area of the road.

Important objectives include the provision of an apparatus for installation on multi-lane highways for selective counting of vehicle traffic on one lane; the provision of an apparatus for installation in a roadway and having a housing configured for placement so as to not hinder traffic in either lane; the provision of an apparatus having a housing assembly in which electrical components are housed which does not constitute a distraction to motorists by reason of its placement and profile.

DETAILED DESCRIPTION OF THE PREFERRED EMBODIMENTS

Figures 1, 2, 3, 4:
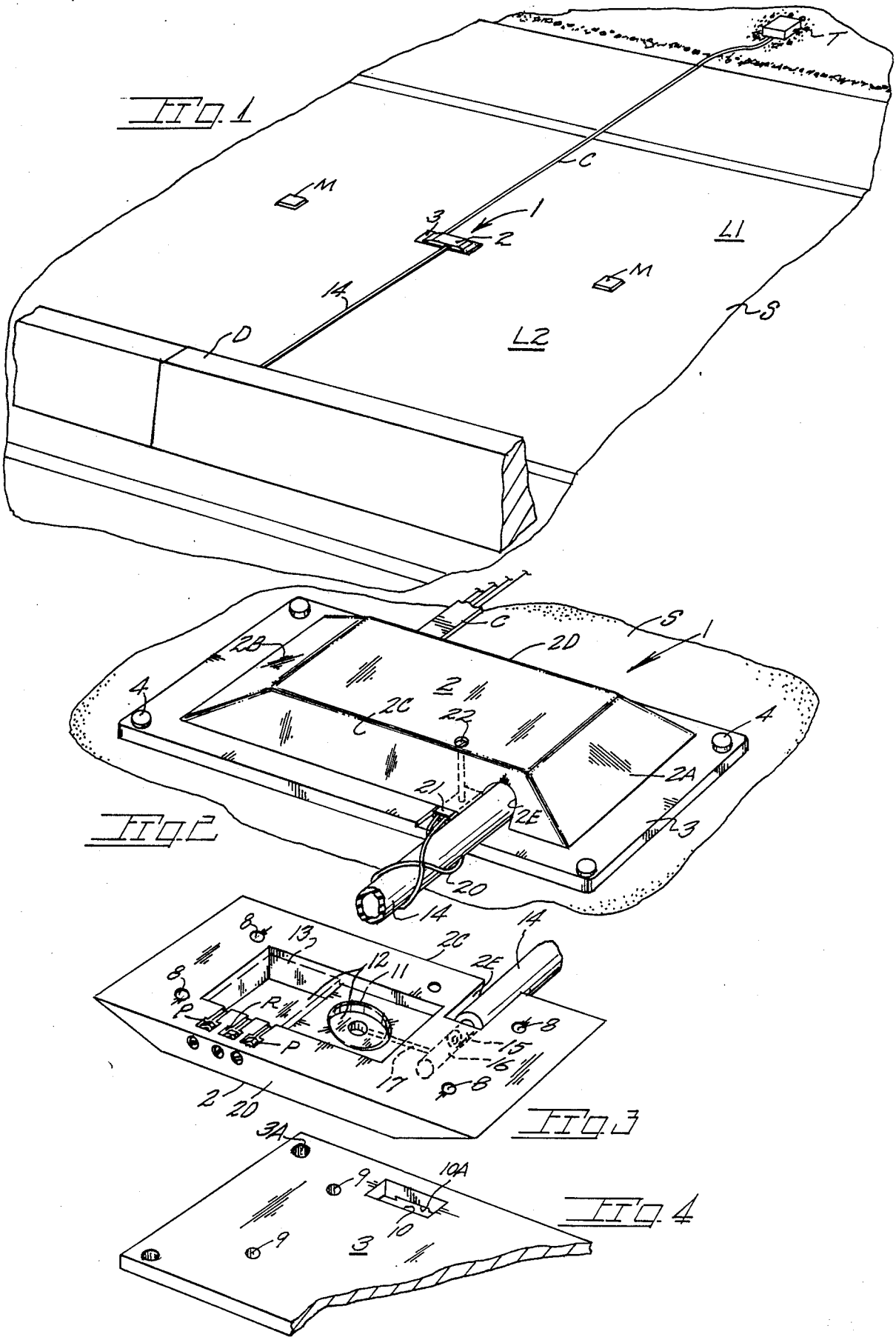
FIG. 1 is a perspective view of a section of roadway equipped with the present traffic counter apparatus.
FIG. 2 is a perspective view of a housing assembly of the present apparatus.
FIG. 3 is a perspective view of a housing of the housing assembly inverted about its major axis from its FIG. 2 position.
FIG. 4 is a fragmentary, perspective view of the base of the housing assembly with the housing removed.

With continuing attention to the drawings wherein applied reference numerals indicate parts similarly hereinafter identified, the reference numeral 1 indicates a housing assembly of the present invention in place on a roadway surface S having multiple, unidirectional lanes L1 and L2 denotes by a row of markers M. A traffic divider is at D.

Housing assembly 1 includes a rectangular (in plan view) housing 2 in place on a base plate 3. The latter is suitably secured to surface S as by fasteners 4 (FIG. 2) which pass through apertures 3A in base 3.

Front and rear housing walls are at 2A and 2B, relative traffic flow therepast, while side walls are at 2C and 2D. To lessen interference with tire passage over the housing, the walls are inclined with front and rear walls 2A and 2B inclined at a shallower or lesser angle to the horizontal base 3 than side walls 2C and 2D. Flat head screws extend upwardly through countersunk bores 9 in the base with the screws seating within threaded bores 8 in the underside of housing 2. Additionally, base plate 3 defines an opening 10 (FIG. 4) for the downward passage of electrical leads from binding posts at P inset in place in recesses R in the underside of the housing. A multi-conductor, flat cable C conducts electrical impulses to a tally device at T. The underside of base plate 3 has a channel 10A to receive the end segment of cable C.

A pressure responsive transducer 11 is mounted in a chamber 12 formed in the underside of the housing which chamber also serves to receive a modular electronic component 13 potted in place and which serves to condition the signals received from the transducer. For transducer operation, a road tube at 14 provides momentary air pressure fluctuations as passing vehicles collapse segments of the tube. Housing 2 has a road tube receiving opening 2E and is suitably bored and fitted with a threaded, tubular nipple 15 having one end disposed in opening 2E to receive the frictionally attached end of road tube 14. Internal bores 16 and 17 of the housing communicate air pressure fluctuations to transducer 11.

To prevent road tube separation from nipple 15, a cable retainer at 20 loops about the tube with cable ends terminating in a flattened ferrule 21 held in place by a fastener 22. Accordingly, road tube 14 may be replaced, if damaged, without disturbing the housing 2.

In use, the apparatus is installed, usually in a temporary manner, with road tube 14 in place across the selected lane or lanes. The housing assembly is of a profile so as to not distract the motorist nor interfere with tire passage thereover. The electrical cable C is of flat section to minimize impact to tires of passing vehicles in the lane or lanes where vehicle traffic is not being counted. The electrical component, transducer 11 is confined against displacement within chamber 12 while the electronic module 13 is fixed in place by the addition of a plastic material which, when it sets, retains the module in place. In some installations, it may be desirable to include a seal or gasket between housing 2 and base plate 3.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A traffic counter apparatus actuated by vehicle travel along a traffic lane of a multi-lane roadway, said apparatus comprising, a housing assembly including a base adapted for securement to the roadway surface between two traffic lanes, a housing having a low profile to said roadway with inclined exterior walls, means removably mounting said housing to said base, said housing defining a chamber closed by said base and constructed of material to withstand being run over by any roadway vehicle, a road tube for disposition in a traffic lane and having an end attached to said housing assembly, pressure responsive transducer switch means in said chamber responsive to air pressure changes in the road tube caused by vehicle passage thereover, thereby producing electrical pulses, signal transmitting means in said chamber connected to and actuated by said pressure responsive switch means for transmitting said electrical pulses and tally means remote from said housing assembly and triggered by said pulses from said signal transmitting means.

2. The traffic counter apparatus claimed in claim 1 wherein said inclined exterior walls are not of uniform inclination relative the base of the housing assembly.

3. The traffic counter apparatus claimed in claim 1 wherein said housing is elongate and of a width so as to lie substantially within a course along a roadway surface denoted by traffic lane markers.

4. The traffic counter apparatus claimed in claim 1 wherein said housing includes a retainer for encircling engagement with one end of said road tube, said housing additionally including terminals to which conductors may be attached, said conductors providing signals to said tally means, said road tube for disposition in a first traffic lane with said conductors for disposition across an adjacent traffic lane and terminating at said tally means.

* * * * *